United States Patent [19]

Duncklee

[11] 4,413,684

[45] Nov. 8, 1983

[54] LASER-CONTROLLED GROUND LEVELING DEVICE WITH OVERFILL SENSOR AND WHEEL RISE LIMITING DEVICE

[76] Inventor: Timothy V. Duncklee, 3124 Collee Ct., Naples, Fla. 33942

[21] Appl. No.: 287,525

[22] Filed: Jul. 27, 1981

[51] Int. Cl.[3] ..... E02F 3/76; A01B 63/112

[52] U.S. Cl. ..... 172/4.5; 37/DIG. 20; 172/12

[58] Field of Search ..... 172/4.5, 7, 12; 37/DIG. 1, DIG. 19, DIG. 20; 414/699; 404/84

[56] References Cited

U.S. PATENT DOCUMENTS

| | | | |
|---|---|---|---|
| 3,462,845 | 8/1969 | Mathews | 172/4.5 X |
| 3,841,777 | 10/1974 | Domenighetti | 404/84 |
| 4,045,893 | 9/1977 | Feinzilber et al. | 172/4.5 X |
| 4,162,708 | 7/1979 | Johnson | 37/DIG. 20 X |
| 4,173,258 | 11/1979 | Boulais et al. | 172/4.5 |
| 4,299,290 | 11/1981 | Nunes, Jr. | 172/4.5 |

FOREIGN PATENT DOCUMENTS

| | | | |
|---|---|---|---|
| 629288 | 9/1978 | U.S.S.R. | 37/DIG. 20 |

*Primary Examiner*—Richard T. Stouffer
*Attorney, Agent, or Firm*—Hauke & Patalidis

[57] ABSTRACT

In combination with a conventional laser beam control system for controlling an earth scraping and storing apparatus, such as a box blade for example, for leveling terrain, an improvement detecting when the box blade is full and overflowing is imminent and sensing the level of the box blade relative to the ground. The improvement overrides the functions of the conventional laser beam controls, when desirable, whereby overfilling and bogging down of the box blade is prevented and whereby rough terrain is readily and effectively leveled.

4 Claims, 3 Drawing Figures

LASER-CONTROLLED GROUND LEVELING DEVICE WITH OVERFILL SENSOR AND WHEEL RISE LIMITING DEVICE

BACKGROUND OF THE INVENTION

The present invention relates to control equipment and, more particularly, to electronic and electrical control equipment for use with a laser beam ground leveling device.

Laser beam ground leveling equipment, that is presently available for leveling agricultural fields and the like, utilizes a laser beam transmitter set up in a field at a selected location and a laser beam receiver that is mounted on a conventional box blade type of scraper towed behind a conventional powered tractor. The laser beam, when received by the receiver, actuates controls in the cab of the tractor that raise and lower the box blade relative to an established grade level.

Presently available laser beam control equipment, however, require that frequently the box blade be controlled manually from the tractor cab while the operator of the tractor steers it over the field along prescribed paths. Thus, the tractor operator has too many things to do to perform leveling work efficiently. It is a prime object of the present invention to eliminate manual operation of the box blade by making the operation of the box blade automatic.

The manner in which the present invention electrically and automatically controls the box blade so that there is no gouging and no undesirable dumping of earth from the box blade will become clear to those of ordinary skill in the art from the following description and drawing of a practical example of the invention.

SUMMARY OF THE INVENTION

The present invention provides an electronic and electrical automatic control system for laser beam ground leveling equipment, a portion of which is mounted on a conventional box blade, and a portion of which is mounted in the cab of a tractor drawing the box blade, interconnected with a conventional laser beam ground leveling control. The invention permits to control the raising and lowering of the box blade to effect leveling the ground to a desired grade level without having to operate the conventional box blade controls manually. The present invention permits to actuate the box blade entirely automatically when so desired.

For a further description of the present invention and for features and advantages of it, reference may be had to the following description and drawing representing an example of practical embodiment of the invention.

DETAILED DESCRIPTION OF THE PREFERRED EMBODIMENT

Figure 1:
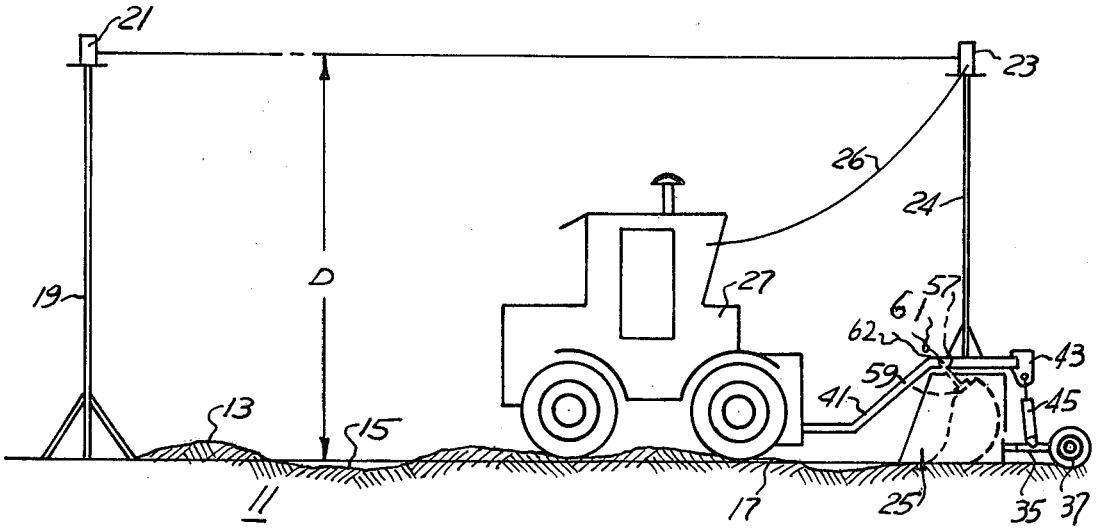
FIG. 1 is a schematic view of a ground leveling operation laser beam effected by means of a tractor-drawn box blade equipped with laser beam control equipment and the control system of the present invention.

Referring to FIG. 1, a plot of ground 11 has both high areas 13 and low areas 15 that are above and below a desired grade level 17. A tripod-supported pole 19 carries at its top a rotating laser beam transmitter 21 that radiates a narrow laser beam which is received by a laser beam receiver 23 mounted atop a pole 24 affixed adjustably to a conventional box blade 25.

Initially the laser beam transmitter 21 is set on the ground at a height "D" above the desired grade level 17. The ground 11 has the usual high areas 13 and the low areas 15 that have to be reduced and filled respectively to achieve the desired grade level 17.

The box blade 25 is attached to and towed behind a conventional powered tractor 27 in the cab of which are conventional laser beam actuated leveling controls that are operated both automatically and manually. Electrical lead wires 26 connect the laser beam receiver with the laser beam control equipment in the cab of the tractor 27.

Figure 2:
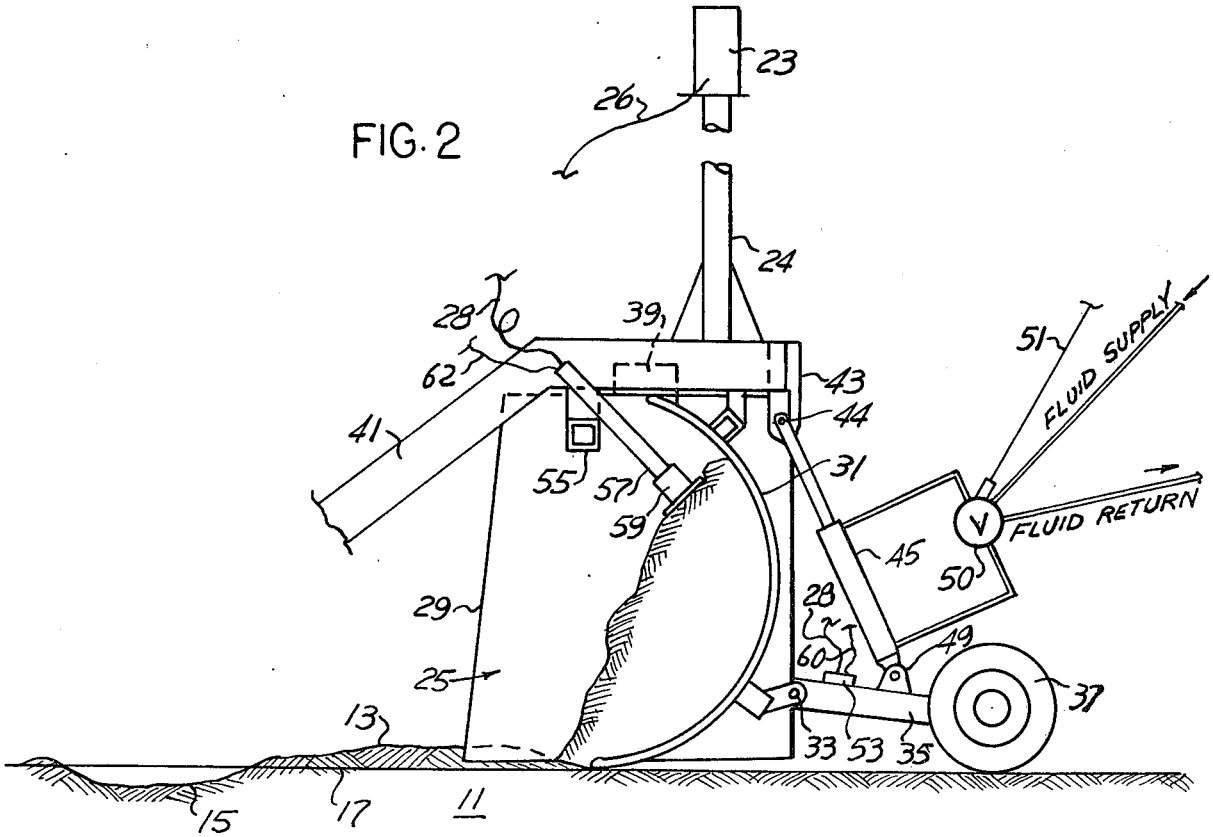
FIG. 2 is a schematic enlarged view of the box blade showing some of the controls of the present invention applied thereto.

Referring to FIG. 2, a schematic view of the box blade 25 is shown with a side plate removed for clarification purposes. The other side plate 29 is fixed to a curved scraper blade 31 to which is mounted pivotally, as at 33, one end of a yoke-carriage 35. The other end of the yoke-carriage 35 is supported by a plurality of rubber tired wheels 37.

The box blade 25 is affixed, as at 39, to another yoke support or drawbar 41 that is attached to the rear of the tractor 27 by a conventional ball and socket arrangement or the like, not shown. Depending from the yoke support 41 is a vertical plate 43 to which is attached the clevis end 44 of a fluid actuated jack in the form of a double acting piston and cylinder assembly 45. The cylinder end portion of the assembly 45 is pivotally connected to a bracket 49 fixed to the yoke-carriage 35, about where shown in FIG. 2. A three-way electrically operated valve 50 is arranged to controllably introduce pressurized fluid to one side or the other of the piston in the piston and cylinder assembly 45 to raise or lower the scraper blade 31.

Mounted also on the yoke-carriage 35 is a level sensor, such as a mercury switch or a mechanical switch 53 that is adjustable.

The three-way valve 50 is operated through a multiconductor electrical cable 51 from a laser control unit mounted in the cab of the tractor 27. The scraper blade 31 is raised when the overall length of the piston and cylinder assembly 45 is lengthened, simultaneously increasing the angle, relative to the ground 17, of the yoke-carriage 35.

The yoke support 41 includes a transverse beam 55 to which is preferably adjustably attached, in any convenient manner, a tubular member 57. The tubular member 57 is angled downwardly, as shown at FIG. 2, and one end of the tubular member carries a fill sensor 59, that is a conventional photoelectric cell. The fill sensor 59 can take any other convenient form indicating filling of the box blade 25 to a predetermined level, such as a mechanical switch, a light beam and light detector, or an infra-red beam and infra-red detector arrangement, for example.

Figure 3:
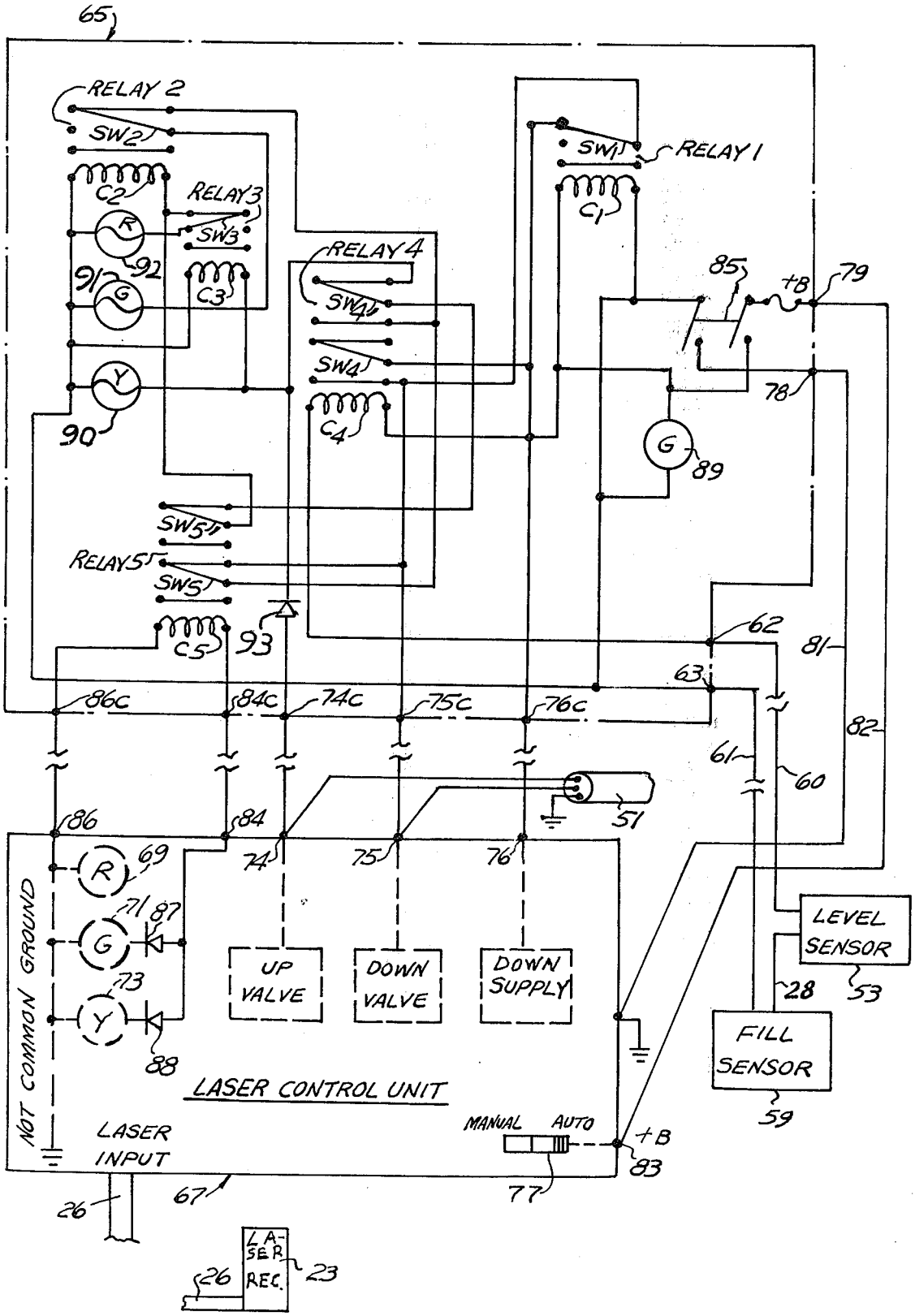
FIG. 3 is a schematic wiring diagram of the control of the present invention interconnected with a conventional laser beam earth leveling control.

As schematically illustrated at FIG. 3, the level sensor 53 and the fill sensor 59, which are electrically connected in series by a wire 28, are connected, by means of lines 60 and 61, across the pair of inputs 62 and 63 of a control circuit 65.

The control circuit 65, forming the crux of the present invention is preferably mounted, in some convenient location within the cab of the tractor 27, proximate the conventional laser circuit unit 67 to which the laser beam receiver 23 is connected through the electric cable 26. The laser control unit 67, such as, for example, that manufactured and sold by Laser Alignment Co., Inc. of Grand Rapids, Michigan, has a power input connected across the tractor electrical system, not shown, and the usual on and off switch. In addition, the laser control unit 67 has three indicator lights, respectively a red indicator light 69, a green indicator light 71 and a yellow indicator light 73 and three output terminals 74, 75 and 76 labeled respectively "up valve", "down valve" and "down supply". The terminals 74 and 75 are connected to the control wires in the electrical cable 51 connected to the three-way flow control valve 50, FIG. 2, operating the jack 45 for raising or lowering the scraper blade 31. In addition, the laser control unit 67 has a toggle switch 77 capable of occupying a manual and an automatic position. When the switch 77 is placed in the manual position, the action of the laser control unit is inhibited, although the indicator lights 69, 71 and 73 may remain activated. When the toggle switch 77 is thrown to the automatic position, the laser control unit 67 operates the raising and lowering of the scraper blade 31 by way of the control valve 50 through the control cable 51 connecting the laser control unit 67 to the valve 50. When the toggle switch 77 is in the manual position, the lifting and lowering of the scraper blade 31 is controlled directly by the tractor operator by means of the usual manual controls, not shown, in the cab of the tractor 27, such manual controls being directly connected to the valve 50, or to a second valve, not shown, placed in parallel in the hydraulic circuit supplying fluid under pressure to the cylinder piston assembly of the jack 45.

The automatic control unit 65 of the invention, in addition to being connected across the level sensor 53 and the fill sensor 59 through its terminals 62 and 63, is further provided with a pair of input terminals 78 and 79 connected respectively via a line 81 to the grounded chassis of the laser control unit 67, and via a line 82 to a terminal 83 provided on the laser control unit 67. Providing the terminal 83, and two other terminals, 84 and 86, and internally disconnecting the "down supply" from the "down valve" are the only modifications that the present invention require to be incorporated in the laser control unit 67. Terminal 83 is connected internally to one of the contacts of the switch 77 such that the B+ voltage applied to the laser control unit 67 appears at the terminal 83 only when the switch 77 is placed in the automatic position, that is when the laser control unit 67 is energized to be functionally active. Under those conditions, voltage is applied across the terminals 79 and 78 of the control circuit 65. By closing a toggle switch 85, the control circuit 65 is turned on, as indicated by an indicator light 89 connected across the terminals 79 and 78 through the switch 85.

The control circuit 65 is further provided with terminals 74*c*, 75*c*, 76*c*, 84*c* and 86*c* which are connected respectively to the terminals 74, 75, 76, 84 and 86 of the laser control unit 67. The terminal 86 is internally connected to a common junction of the red, green and yellow indicator lights 69, 71 and 73 of the laser control unit 67 while the terminal 84 is connected through diodes 87 and 88, respectively, to the other terminal of the green indicator light 71 and the yellow indicator light 73, such that a signal in the form of a voltage is applied to the terminal 84 when either the green light 71 or the yellow light 73 of the laser control unit 67 is turned on. When the laser control unit 67 is in operation, the green indicator light 71 being "on" provides to the operator an indication that grading is effected normally. When the red indicator light 69 turns "on", it provides an indication that grading is being effected at too high a level, namely with the laser beam receiver 23 being positioned above the axis of the laser beam emitted by the transmitter 21, FIG. 1. When the yellow indicator light 73 turns "on", it provides an indication to the operator that grading is being effected at too low a level.

The control circuit 65 comprises a relay 1 having a coil C1 connected across the terminals 78 and 79 through the switch 85. The switch SW1 of the relay 1 is normally closed, thus shunting the terminals 75*c* and 76*c* of the control circuit 65 and therefore interconnecting the supply voltage of the laser control unit 67 to the "down valve" command terminal 75. When electrical power is applied to the control circuit 65 the coil C1 of the relay 1 opens the switch SW1, and the terminals 75 and 76 of the laser control unit 67 are no longer interconnected thus allowing the laser control unit 67 to have its action modified by the control circuit 65 as hereinafter explained in further detail.

The control circuit 65 is provided with three indicator lights, a yellow light 90, a green light 91 and a red light 92. A common terminal of the three indicator light 90, 91 and 92 is connected to ground when the control circuit switch 85 is closed. The other terminal of the yellow indicator light 90 is connected through a diode 93 to the terminal 74*c* of the control circuit, and consequently to the "up valve" terminal 74 of the laser control unit 67. The other terminal of the green indicator light 91 is connected through the normally closed switch SW2 of a relay 2 and through the normally closed switch SW5 of a relay 5 to the terminal 75*c* of the control circuit 65 and consequently to the "down valve" terminal 75 of the laser circuit unit 67. The other terminal of the red indicator light 92 is connected through the normally closed switch SW3 of a relay 3, through the normally closed switch SW5' of the relay 5 and through the normally closed switch SW4' of a relay 4 to the terminal 74*c* of the control circuit 65, via a diode 93. The sole function of the relay 2 is to turn off the green indicator light 91 when the red indicator light 92 is on, therefore causing the coil C2 of the relay 2 to open the switch SW2 of the relay 2. The function of the relay 3 is to turn off the red indicator light 92 when the yellow indicator light 90 comes on, therefore causing the coil C3 of the relay 3 to be energized, opening the switch SW3 of the relay 3.

The relay 4 has a normally open switch SW4 and a coil C4 which is in the series circuit of the level sensor 53 and fill sensor 59, which each consists of a normally closed switch. The fill sensor 59 and the level sensor 53 being normally closed switches, when power is applied to the control circuit 65, current flows through the coil C4 of the relay 4. The switch SW4 of the relay 4 closes, thus placing the terminal 75*c* of the control circuit 65 in connection with the terminal 76*c*, thus in turn connecting the "down valve" control terminal 75 to the "down supply" terminal 76, with the result that the scraper blade 31 is commanded, FIG. 2, downwardly such as to take the bigger bite in the ground. At the same time, the switch SW4' opens the circuit of the yellow indicator light 90 and closes the circuit of the green indicator light 91.

When the fill sensor 59 becomes covered with earth being scraped by the scraper blade 31, ambient light no longer reaches the photocell of the fill sensor 59, and the photocell no longer conducts electricity. The fill sensor 59 having become an open switch, the "down valve" control terminal 75 of the laser control unit 67 is no longer connected to the supply terminal 76, with the result that the scraper blade 31, FIG. 2, is commanded upwardly. Similarly, when the angle of the yoke-carriage 35 pivotally connecting the box blade 25 to the wheels 37 exceeds the angle limit for which the level sensor 53 has been set, the circuit of the level sensor 53 and fill sensor 59 opens, and the wheels 37 of the scraper blade 31 are commanded downwardly. The level sensor 53 has for its principal purpose to prevent the wheels 37 to come off the ground too high. When traveling over hard ground, for example, it often happens that the scraper blade 31 does not cut deep enough and the wheels 37 come up off the ground. Under the normal control of the laser beam control unit 67, because the box blade has been displaced upwardly, and consequently the laser beam receiver 23 has been displaced upwardly relative to the level of the laser beam, automatic control of the piston and cylinder assembly 45 causes the wheels 37 to continuously raise up, with the result that the scraper digs heavily into the ground. Because the wheels have been raised very high in the air, they can not be returned by the piston and cylinder assembly 45 to a normal position fast enough to prevent the scraper blade 31 from digging a substantially deep hole in the ground.

The control circuit 65 of the invention further comprises a relay 5 having a coil C5 connected across the terminals 86c and 84c, and therefore across the terminals 86 and 84 of the laser control unit 67. Consequently, the relay 5 is activated any time either the green indicator light 71 or the yellow indicator light 73 of the laser control unit 67 is on. When the relay 5 is activated, it opens its normally closed switches SW5 and SW5'. The opening of the switch SW5 turns off the green indicator light 91, which results in turning on the red indicator light 92. The opening of the switch SW5' commands the scraper blade 31 downwardly, unless the fill sensor 59 or the level sensor 53 is open, thus preventing the box blade 25 from coming down. The invention, therefore, permits to remedy one of the shortcomings of the conventional laser control system resulting from the condition present when the box blade 25 is at a high spot in the field that causes the laser beam receiver 23 to be out of range, as being too high, which causes the laser alignment system to become inoperative. When the laser control system becomes inoperative, the operation of the box blade 25 has to be effected, for example lowered, manually. With the present invention, when the laser beam receiver 23 is too high, the relay 5 of the control circuit 65 lowers the box blade 25 automatically.

In a typical operative situation, wherein a field of ground is to be leveled to some arbitrary grade level 17, FIGS. 1 and 2, the box blade 25 is initially empty and may be brought down to ground level by operating the piston and cylinder assembly 45. The tractor 27 draws the box blade 25 over the preselected area of the field to be leveled, such field having high areas 13 and low areas 15 relative to grade level 17. The conventional laser control unit 67, FIG. 3, in the cab of the tractor 27 is activated and the control circuit 65 of the present invention is also activated.

Assuming at first that the box blade 25 is set adjacent a high area 13 and the tractor 27 commences to draw the box blade 25 over the high area 13, the box blade 25 begins to fill with earth until it is full, but the conventional laser beam control equipment would not indicate when the box blade 25 is full of earth. Without the improvement of the invention, when the box blade 25 becomes full of earth, the wheels 37 start to raise up from the ground and the tractor begins to bog down. Therefore, the tractor operator is required to manually override the laser control unit 67 and to operate the box blade 25 through the manual controls in the tractor cab. The box blade 25 is then raised and excess earth drops from the box blade.

As soon as enough earth has been dumped from the box blade 25, the tractor operator reactivates the laser beam control unit 67. When the box blade 25 again becomes full of earth, the tractor operator must again operate the conventional controls manually. It is apparent that the tractor operator must be alert to operate the controls manually while steering the tractor over the prescribed path in the field, and to switch from manual to automatic control as required. When the box blade 25 overfills, the operator is forced to find a low area 15 in the field where the excess earth can be dumped. The operator must ever be alert for overfilling of the box blade, in which situation the operator must revert to manual control. Because most fields are not level, the box blade will be filled continually and the operator of the tractor must work the controls manually a great deal of the total time spent in leveling the field.

In contrast to the way the conventional laser beam control equipment operates, the present invention controls filling and dumping of the fill box or box blade 25 automatically and without operating the manual controls, as long as the conventional laser beam control unit 67 is on automatic position, and prevents overfilling and bogging down of the box blade 25.

When the box blade fills with earth so that the earth covers the photoelectric cell fill sensor 59, as shown at FIG. 2, the controls of the present invention override the conventional laser beam controls and equipment, and the box blade 25 raises and starts to dump some of the earth, thereby exposing the photoelectric fill sensor 59 to daylight.

The mercury or mechanical switch forming the level sensor 53 prevents the wheels 37 from going up too high and causing digging into deep, thus eliminating one of the inconveniences of the conventional laser beam control system.

In a situation wherein the box blade 25 is on a very high area of the field, relatively speaking, the conventional laser beam control equipment continues to command the scraper blade 31 to dig in. The wheels 37 come up off the ground and the tractor bogs down as the box blade 25 becomes overfilled. The improvement of the present invention prevents digging in and overfilling of the box blade 25 because as soon as the circuit including the level sensor 53 and the fill sensor 59 is broken, some earth is dumped by the raising of the box blade 25.

When the red indicating light 92 turns on, it indicates that the box blade 25 is being lowered to grade after dumping some earth. When the box blade 25 reaches grade level, the red indicating light 92 goes off and as soon as the green light 91 comes on, the conventional laser beam control unit 67 takes over.

When the green light 71 of the laser control unit 67 is "on", it indicates that the box blade 25 is on grade with the laser beam receiver 23 receiving the beam emitted by the laser beam transmitter 21. When the yellow light 73 of the laser control unit 67 is "on", it indicates that the box blade 25 is below level. In both those conditions, either when working at grade level or working below grade level, down movement of the scraper blade 31 which will result in scraping more earth should ideally be avoided. Because the relay 5 is switched "on" any time the green indicator light 71 or the yellow indicator light 73 is "on", any down movement of the blade box 25 is prevented, as previously mentioned.

Having thus described the present invention by way of an example of structure thereof well adapted to accomplish the objects of the invention, modifications whereof will be apparent to those skilled in the art, what is claimed as new is as follows:

1. In an earth leveling laser beam control system comprising earth scraping and storing means controllably displaceable over rough terrain for leveling said terrain, level defining laser beam transmitting means, laser beam receiving means mounted on said earth scraping and storing means, indicating means associated with said laser beam receiving means for indicating alignment of said earth scraping and storing means with said laser beam, and control means for lowering and raising said earth scraping and storing means for leveling said rough terrain to a pre-determined grade level as defined by said laser beam, the improvement comprising overfill sensor means in said scraping and storing means for detecting an excess of scraped earth in said scraping and storing means, means actuated by said overfill sensor means for dumping earth from said scraping and storing means upon receiving an appropriate signal from said overfill sensor means for preventing overfilling of said scraping and storing means, means actuated by said indicating means for preventing said control means from lowering said earth scraping and storing means while said indicating means is on, ground engaging wheels, pivotable support means interconnecting said ground supported wheels and said earth scraping and storing means, and control means mounted on said pivotable support means for maintaining said pivotal support means below a pre-determined angle for limiting the rise of said ground engaging wheels above the ground.

2. The improvement of claim 1 wherein said laser beam control means is provided with means indicating that said earth scraping and storing means is below said laser beam, and wherein said improvement further comprises means actuated by said indicating means for preventing said control means from lowering said earth scraping and storing means while said below said laser beam indicating means is on.

3. The improvement of claim 1 further comprising visual indicating means of the lowering and raising of said earth scraping and storing means.

4. The improvement of claim 3, wherein said alignment indicating means further comprises visual indicating means indicating that said earth scraping and storing means is not raised nor lowered.

* * * * *